US006964270B2

(12) United States Patent
Janssen et al.

(10) Patent No.: US 6,964,270 B2
(45) Date of Patent: Nov. 15, 2005

(54) DUAL MODE EGR VALVE

(75) Inventors: John M. Janssen, Columbus, IN (US); Bruce A. Watson, Columbus, IN (US); Charles R. Schenk, Ypsilanti, MI (US); Josh S. Shao, Columbus, IN (US); Lester L. Peters, Columbus, IN (US); David L. Buchanan, Westport, IN (US); Wayne A. Eckerle, Columbus, IN (US); Julius P. Perr, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 10/637,361

(22) Filed: Aug. 8, 2003

(65) Prior Publication Data

US 2005/0028797 A1 Feb. 10, 2005

(51) Int. Cl.[7] ..... F02M 25/07
(52) U.S. Cl. ..... 123/568.26; 123/568.13
(58) Field of Search ..... 123/321, 322, 123/568.11, 568.14, 568.18, 568.19, 568.2, 347, 348, 58.8, 568.23, 568.13, 568.26, 90.15, 90.16

(56) References Cited

U.S. PATENT DOCUMENTS

| | | | | | |
|---|---|---|---|---|---|
| 2,889,904 | A | | 6/1959 | Martinoli | |
| 3,804,120 | A | | 4/1974 | Garnett | |
| 3,834,363 | A | | 9/1974 | Goto et al. | |
| 4,224,906 | A | * | 9/1980 | Happel | 123/568.14 |
| 4,282,845 | A | | 8/1981 | Nohira et al. | |
| 4,561,408 | A | * | 12/1985 | Jenkins | 123/568.23 |
| 4,617,968 | A | | 10/1986 | Hendrixon | |
| 5,255,641 | A | | 10/1993 | Schechter | |
| 5,284,220 | A | | 2/1994 | Shimizu et al. | |
| 5,406,918 | A | * | 4/1995 | Joko et al. | 123/321 |
| 5,448,973 | A | | 9/1995 | Meyer | |
| 5,485,819 | A | * | 1/1996 | Joko et al. | 123/321 |
| 5,829,396 | A | | 11/1998 | Sturman | |
| 5,901,690 | A | | 5/1999 | Hussey et al. | |
| 5,964,406 | A | | 10/1999 | Zuo | |
| 6,039,022 | A | * | 3/2000 | Meistrick et al. | 123/321 |
| 6,067,946 | A | | 5/2000 | Bunker et al. | |
| 6,085,991 | A | | 7/2000 | Sturman | |
| 6,125,828 | A | * | 10/2000 | Hu | 123/568.14 |
| 6,170,474 | B1 | * | 1/2001 | Israel | 123/568.14 |
| 6,257,213 | B1 | * | 7/2001 | Maeda | 123/568.14 |
| 6,390,079 | B1 | * | 5/2002 | Gagnon et al. | 123/568.23 |
| 6,640,771 | B2 | * | 11/2003 | Fuerhapter | 123/568.14 |

* cited by examiner

*Primary Examiner*—Willis R. Wolfe, Jr.
(74) *Attorney, Agent, or Firm*—Woodard, Emhardt, Moriarty, McNett & Henry, LLP

(57) ABSTRACT

A preferred embodiment EGR valve permits exhaust gas to be induced into the intake line downstream of the compressor, while minimizing the need to reduce the size of the turbocharger. The preferred embodiment EGR valve exploits variations around the mean pressure in the EGR passage created by the engine cycle by selectively opening when the pressure in the EGR valve exceeds the pressure in the intake line. Thus, exhaust gas is recirculated even when the engine is running near torque peak. The preferred embodiment EGR valve also exploits the higher mean pressure in the exhaust line relative to the intake line at higher engine speeds by remaining open, in order to minimize the energy consumed in opening and closing the EGR valve.

44 Claims, 9 Drawing Sheets

DUAL MODE EGR VALVE

TECHNICAL FIELD OF THE INVENTION

The present invention generally relates to internal combustion engines and, more particularly, to a dual mode exhaust gas recirculation ("EGR") valve for such engines.

BACKGROUND

As is well known in the art, the combustion of hydrocarbon-based fuels in an internal combustion engine produces as a byproduct several undesirable oxides of nitrogen (NOx emissions). The release of such NOx emissions is tightly regulated by governmental authorities in many parts of the world. Exhaust gas recirculation ("EGR"), in which exhaust gases are recirculated to the engine's intake manifold in order to undergo further combustion, is a proven method for reducing NOx emissions. Unfortunately, EGR is difficult to implement on turbocharged engines, such as turbocharged diesel engines, for example. This is because turbocharged engines often have a mean exhaust manifold pressure below the mean intake manifold pressure near peak torque output operating point ("torque peak"), such that the exhaust gases will not automatically flow to the intake manifold if a connection is made between the intake and exhaust manifolds.

Until recently, engine designers could compensate for a lack of EGR at torque peak by providing extra EGR at high engine speeds, resulting in an acceptable average level of NOx emissions. But U.S. governmental regulations taking effect in 2002 require substantial NOx reductions at all engine speeds and loads involved in typical operation. In order to satisfy these regulations it will be necessary to utilize EGR at almost all engine operating points. A particular problem is how to obtain sufficient EGR at or near torque peak without compromising performance elsewhere.

Thus, there is a need for an EGR system that is capable of providing EGR at all speeds and loads, including torque peak, without harming engine performance at other conditions. The present invention is directed towards meeting this need.

SUMMARY OF THE INVENTION

A first embodiment EGR system for use on an internal combustion engine comprises: at least one hydraulic master cylinder; a slave cylinder in fluid communication with the hydraulic master cylinder and having a slave piston; and an EGR valve coupled to the slave piston and biased in a closed position.

A second embodiment EGR system for use on an internal combustion engine comprises: at least one hydraulic master cylinder; a slave cylinder in fluid communication with the hydraulic master cylinder and having a slave piston; a hydraulic manifold in fluid communication with the at least one hydraulic master cylinder and the slave cylinder; an EGR valve coupled to the slave piston and biased in a closed position; a three-port control valve; and a mode control valve. The three-port control valve has a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state. The second port has a check valve to prevent backflow of hydraulic fluid from the hydraulic manifold into the source of hydraulic fluid. The mode control valve separates the hydraulic manifold and the slave cylinder, and comprises: a check valve that permits fluid to flow from the hydraulic manifold into the slave cylinder, a closeable bypass that, when open, permits fluid to flow from the hydraulic manifold into the slave cylinder and from the slave cylinder into the hydraulic manifold. The at least one hydraulic master cylinder is actuated by at least one rocker arm of the engine.

A third embodiment EGR system comprises: a EGR valve biased in a closed position; a piston coupled to the EGR valve; a cam at least able to be in mechanical communication with the piston, such that when the cam rotates the piston is actuated.

A fourth embodiment dual mode EGR system for use on a combustion engine having an intake line and a compressor comprises: an EGR passage having at least one aperture that opens into the intake line downstream of the compressor; an EGR valve that blocks flow through the EGR passage when closed; and an actuator coupled to the EGR valve, and adapted to operate in at least a first mode and a second mode. In the first mode, the actuator at least partially opens the EGR valve and leaves it at least partially open. In the second mode, the actuator successively opens and closes the EGR valve synchronously with increases in a pressure in the EGR passage.

A fifth embodiment dual mode EGR system for use on a combustion engine having an intake line and a compressor comprises: an EGR passage having at least one aperture that opens into the intake line downstream of the compressor; an EGR valve that blocks flow through the EGR passage when closed; a spring disposed to bias the EGR valve in a closed position; an actuator coupled to the EGR valve, and adapted to operate in at least a first mode and a second mode. The actuator comprises: at least one hydraulic master cylinder; a slave cylinder in fluid communication with the hydraulic master cylinder and having a slave piston, the slave piston being coupled to the EGR valve; a hydraulic manifold in fluid communication with the at least one hydraulic master cylinder and the slave cylinder; a three-port control valve; and a mode control valve. The three-port control valve has a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state. The second port has a check valve to prevent backflow of hydraulic fluid from the hydraulic manifold into the source of hydraulic fluid. The mode control valve separates the hydraulic manifold and the slave cylinder, and comprises: a check valve that permits fluid to flow from the hydraulic manifold into the slave cylinder, and a closeable bypass that, when open, permits fluid to flow from the hydraulic manifold into the slave cylinder and from the slave cylinder into the hydraulic manifold. When the engine operates near torque peak the actuator functions in the second mode by placing the three-port control valve in the second state and opening the closable bypass.

A sixth embodiment dual mode EGR system for use on a combustion engine having an intake line and a compressor comprises: an EGR passage having at least one aperture that opens into the intake line downstream of the compressor; an EGR valve that blocks flow through the EGR passage when closed; a spring disposed to bias the EGR valve in a closed position; an actuator coupled to the EGR valve, and adapted to operate in at least a first mode and a second mode. The actuator comprises: a piston coupled to the EGR valve; a cam in mechanical communication with the piston, such that when the cam rotates the piston is actuated; and a motor coupled to the cam. The motor of the actuator is moved to and left in an angular position that opens the EGR valve unless the engine is operating near torque peak.

A seventh embodiment dual mode EGR system for use on a combustion engine having an intake line and a compressor comprises: an EGR passage having at least one aperture that opens into the intake line downstream of the compressor; an EGR valve that blocks flow through the EGR passage when closed; a spring disposed to bias the EGR valve in a closed position; an actuator coupled to the EGR valve, and adapted to operate in at least a first mode and a second mode. The actuator comprises: a piston coupled to the EGR valve; a cam; a chamber; a fill line adapted to direct hydraulic fluid into the chamber; and a variable tappet in contact with the chamber and that places the cam and piston in mechanical communication. The piston opens the EGR valve when the cam rotates when the tappet is at least partially collapsed and the chamber is not filled. When the chamber contains more than a pre-determined amount of fluid the tappet is actuated such that the EGR valve is at least partially opened and the cam is removed from mechanical communication with the piston

Figure 1:
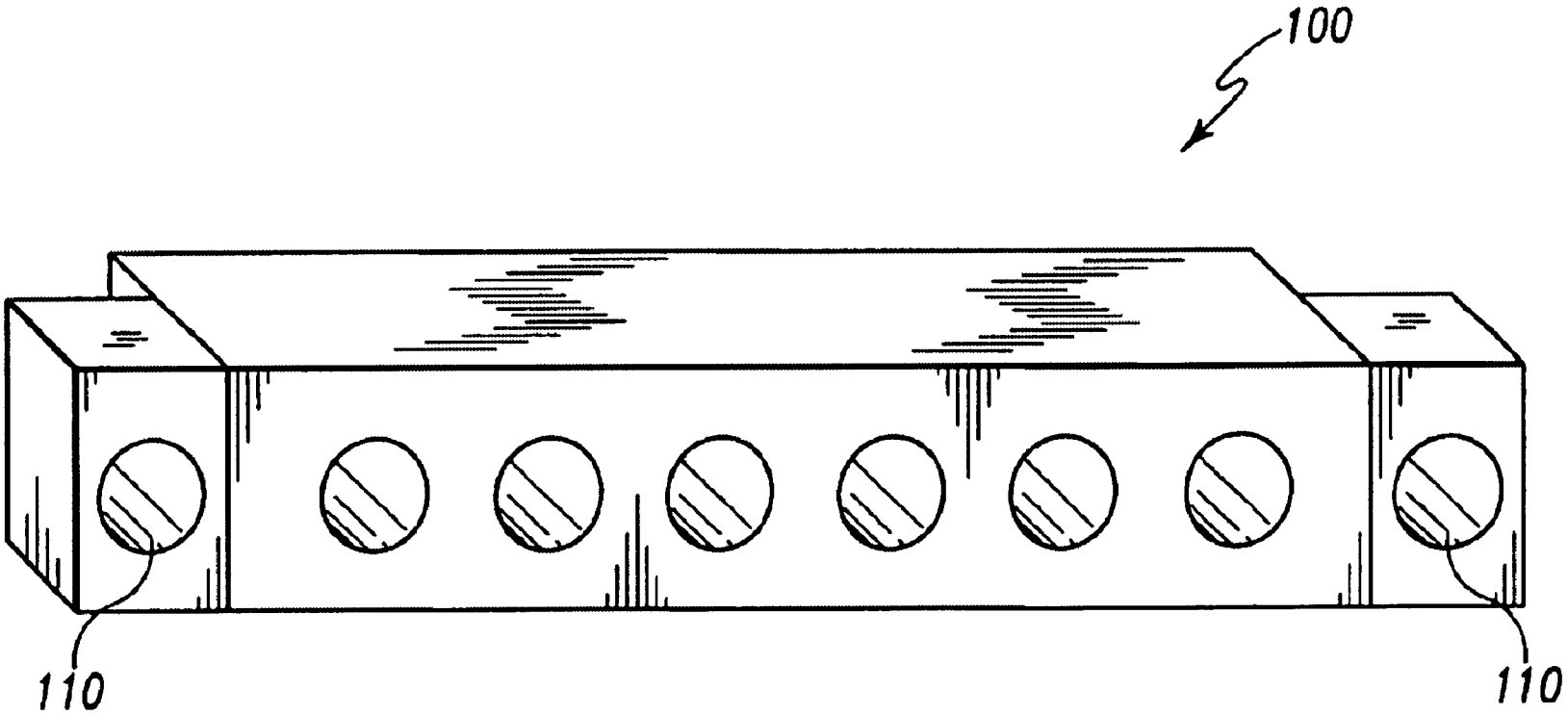
FIG. 1 is a perspective drawing of an engine head suitable for use with a preferred embodiment EGR system according to the present invention.

The EGR lift valve can be cycled from closed to open and back to closed again by the actuation of the pilot valve 870, as will be apparent to those skilled in the art.

DETAILED DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. In particular, although the preferred embodiment is described in the context of a six cylinder, four-stroke engine, it may nonetheless be used with other types of engines with such alterations as will be apparent to those skilled in the art.

A presently preferred embodiment EGR system according to the present invention has several advantages over the prior art. In particular, a presently preferred embodiment EGR valve according to the present invention permits exhaust gas to be induced into the intake line downstream of the compressor, while minimizing the need to reduce the size of the turbocharger turbine casing. The preferred embodiment EGR valve exploits variations around the mean pressure in the EGR passage created by the engine cycle by selectively opening when the pressure in the EGR valve exceeds the pressure in the intake line. Thus, exhaust gas is recirculated even when the engine is running near torque peak. The preferred embodiment EGR valve also exploits the higher mean pressure in the exhaust line relative to the intake line at higher engine speeds by remaining open, in order to minimize the energy consumed by opening and closing the EGR valve and associated wear on the valve and actuator mechanism.

FIG. 1 is a perspective view of a 6-cylinder head suitable for use in a preferred embodiment EGR system according to the present invention, indicated generally at 100. At each end of the head 100 is an EGR inlet 110. Those skilled in the art will recognize that the EGR inlets 110 and associated valves can be located at any convenient location. In particular, locating them together adjacent to the exhaust ports for cylinders 3 and 4 may simplify the outlet plumbing considerably and allow both valves to be housed in a single casting. In certain applications, sufficient EGR can be generated through only one EGR valve. Therefore, in certain alternative embodiments, the head 100 has only one EGR inlet 110. The EGR inlets 110 are preferably integrally formed as part of the head 100. In certain alternative embodiments, the EGR inlets 110 are bolted on. In certain other alternative embodiments, the EGR inlets are separated from the head entirely, in order to be positioned elsewhere on the engine, and are coupled to the head by additional plumbing.

The EGR inlets 110 house EGR valves that function in one of at least two modes: stationary, and oscillating. In the oscillating mode, the EGR valves open and close synchronously with high-pressure pulses occurring in the exhaust manifold (and propagating through the EGR passage) as the various cylinders blow down. In the stationary mode, the EGR valves can be held closed, partially open, or fully open.

Figure 2:
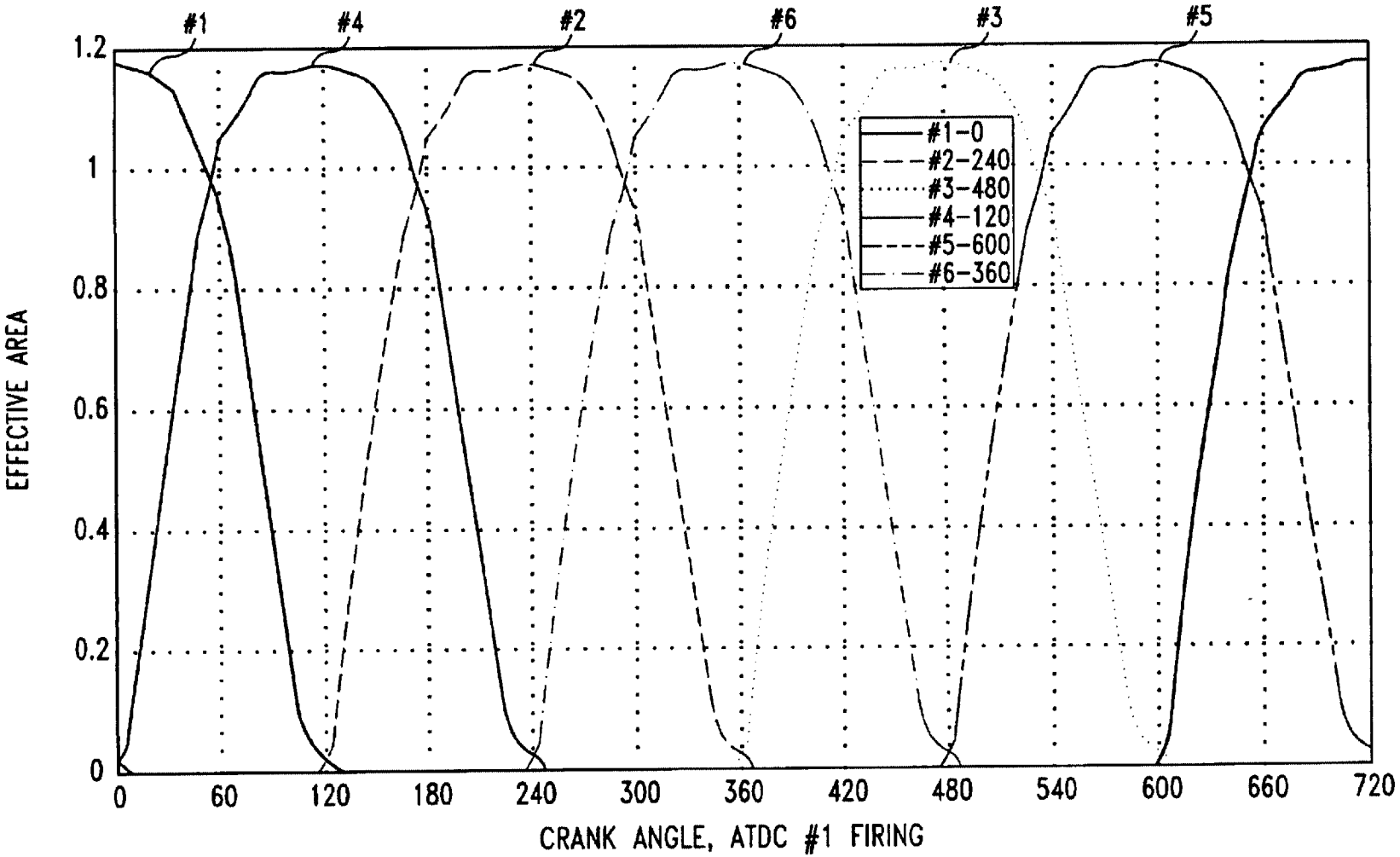
FIG. 2 is a graph of effective area vs. crank angle during exhaust events in a six cylinder engine.

FIG. 2 illustrates the exhaust events of three adjacent cylinders in a six cylinder, four-stroke engine. Because they are almost completely separated, the existing cam lobes can actuate an EGR valve synchronously with the high-pressure pulses that propagate from the manifold through the EGR passage. In certain embodiments, three followers, independently following their cams, each activate the same EGR valve. In certain of these embodiments, in order to operate in static mode, a clutch mechanism is used to prevent the followers from returning past the outer base circle. In these embodiments, generally one follower is activated at any time, while the other two are on inner-base-circles of their cam with lash in their trains. By grouping cylinders 1, 2 and 3 together with a single EGR inlet, and grouping cylinders 4, 5 and 6 together with a second EGR inlet, the blowdown events are distinctly separated in time (see FIG. 2) and the pulse pressure may be harvested to drive the EGR flow. Without this separation, the exhaust pressure is more even and is lower.

The present invention works best with a divided exhaust manifold with a separate EGR valve on each manifold. A single EGR valve could be connected to all six cylinders and oscillating six times per two engine revolutions, but EGR flow would be considerably less (but possibly sufficient in some applications). Another alternative embodiment would be to use a modulated valve on 3 cylinders and a dual-mode valve on the other three cylinders. EGR flow would be comparable as in the preferred embodiment except near torque peak. The trade-off is that the system cost would be less, and the system might be sufficient depending upon the level of NOx reduction required.

Figures 3A, 3B, 3C:
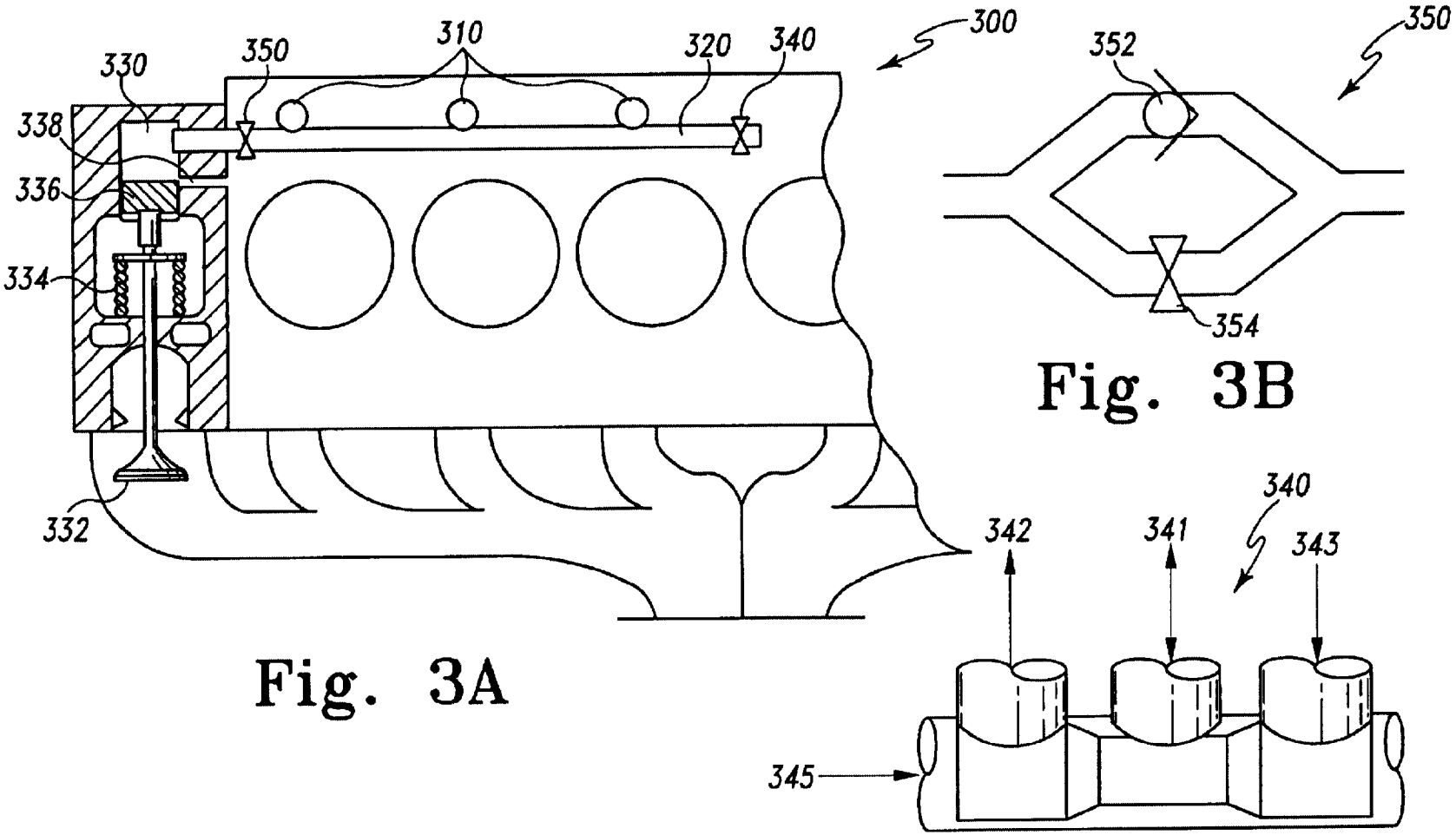
FIG. 3A is a cross-sectional view of a first embodiment EGR system according to the present invention employing a hydraulic EGR valve.
FIG. 3B is a schematic diagram of a mode-control valve suitable for use in the first embodiment EGR system of FIG. 3A.
FIG. 3C is a perspective view of a 3-port control valve suitable for use in the first embodiment EGR system of FIG. 3A.

FIG. 3 illustrates a system for hydraulic actuation of the EGR valves, indicated generally at 300. Master hydraulic cylinders 310 are mounted above the exhaust rockers, such that the exhaust rockers actuate the master cylinders 310. The master cylinders 310 pump hydraulic fluid (preferably lubricating oil from the engine's oil circulation system) into a hydraulic manifold 320, which is in fluid communication with a slave cylinder 330. The hydraulic manifold includes a 3-port control valve 340 and a mode control valve 350. The slave cylinder 330 contains a slave piston 336 that is coupled to an EGR poppet valve 332, and which is biased into the closed position by a EGR valve spring 334. The slave cylinder 330 also includes a bleed line 338. The mode control valve 350 comprises a check valve 352 in parallel with a bypass valve 354, as shown in FIG. 3*a*. When the bypass 354 is closed, the check valve 352 permits the flow of hydraulic fluid into the slave cylinder 330, but not back into the hydraulic manifold 320.

For the purposes of this document, fluid communication through a check valve will be referred to as "checked fluid communication," and fluid communication that does not pass through a check valve will be referred to as "direct fluid communication." The term "fluid communication" can mean either checked or direct fluid communication. Thus, when the bypass 354 is open, the slave cylinder 330 and the hydraulic manifold 320 are in direct fluid communication, and when the bypass 354 is closed, they are in checked fluid communication.

Further details of the three-port control valve 340 are shown in FIG. 3*b*. A first port 341 of the three-port control valve 340 connects to the hydraulic manifold 320. In a first state, a second port 342 of the three-port control valve 340 also connects with the hydraulic fluid supply. In a second state a third port 343 connects to a hydraulic fluid drain. An input control 345 is used to switch the three-port control valve 340 between the first and second states. The hydraulic manifold 320 is placed into fluid communication with the hydraulic fluid source when the three-port control valve 340 is in the first state, and with the drain when it is in the second state. The three-port control valve 340 preferably has a check valve that prevents backflow into the fluid source even when it is in the first state. Thus, the three-port control valve 340 can be opened to the hydraulic fluid supply in order to fill the hydraulic manifold 320 with hydraulic fluid. The check valve prevents backflow when the pressure in the hydraulic manifold 320 exceeds the pressure in the oil supply, such as when master hydraulic cylinders 310 pump.

The system 300 is placed into oscillating mode by filling the hydraulic manifold 320 and opening the bypass 354. In this way, when the exhaust rockers rise, they actuate the master hydraulic cylinders 310, and hydraulic fluid flows through the hydraulic manifold 320 and into the slave cylinder 330, driving the slave piston 336 and opening the EGR poppet 332. When the exhaust rockers drop, the hydraulic fluid flows back through the bypass 354 into the hydraulic manifold 320 and master cylinders 310, permitting the EGR poppet 332 to close again.

The system 300 is placed in static mode by closing the bypass 354 so that the slave cylinder 330 fills with hydraulic fluid until the desired lift on the EGR poppet 332 is reached, and then the three-port control valve 340 is opened to the hydraulic fluid drain to empty the hydraulic manifold 320. The aperture of the bleed line 338 is positioned so that it is uncovered when the slave piston 336 reaches maximum travel, in order to prevent over-travel of the piston 336 and poppet 332. If less than maximum lift of the poppet 332 is needed, further fluid can be drained by opening the mode control valve 350.

In certain alternative embodiments, the hydraulic master cylinders 310 are driven directly by the cam lobes, rather than by the exhaust rockers. In order to reduce the peak stress on the cam lobe and follower, or in order to deal with a lack of space around a single follower, the master cylinders 310 can be driven by followers positioned elsewhere from the current follower. For example, in a six-cylinder engine, the master cylinders can be driven by a follower 120 degrees away from the current follower.

In certain other embodiments, an additional cam is used to drive a single cylinder. In certain of these embodiments, the additional cam is positioned on the camshaft. In certain other of these embodiments, the additional cam is driven independently, but synchronously.

Figure 4B:
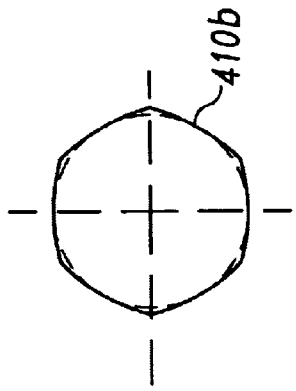
FIG. 4B is a cross-sectional view of a three-lobe cam suitable for use in the second embodiment EGR system of FIG. 4A.
Figure 4C:
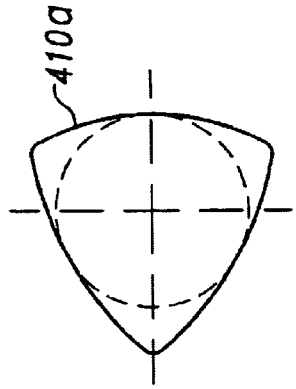
FIG. 4C is a cross-sectional view of a six-lobe cam suitable for use in the second embodiment EGR system of FIG. 4A.
Figure 4A:
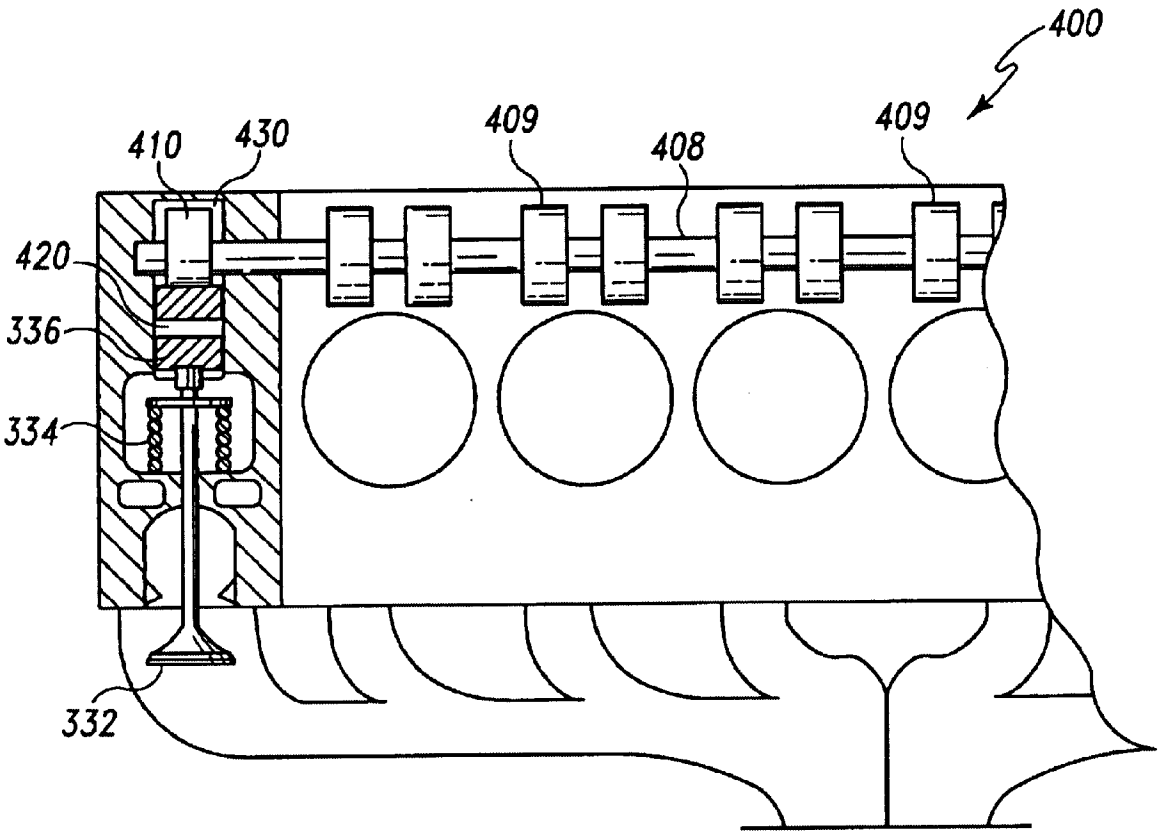
FIG. 4A is a cross-sectional view of a second embodiment EGR system according to the present invention employing an additional cam on the camshaft to drive the EGR valve.

FIG. 4 illustrates an embodiment, shown generally as 400, in which an additional cam 410 on the camshaft 408 that drives the intake and exhaust cams 409 is used to drive a piston 336 and an EGR poppet 332 coupled thereto. The additional cam 410 actuates a variable tappet 420, which is adjacent to a piston 336. The piston 336 is coupled to a poppet 332 and is biased by an EGR valve spring 334. A three-lobe cam 410*a* can be used if the EGR from three cylinders is sufficient, (for example, if the head 100 includes two EGR inlets 110 and EGR poppets 332, such that each can function to accept EGR from the high-pressure pulses produced by the adjacent trio of cylinders). Alternatively, a six-lobe cam 410*b* can be used if EGR from all six cylinders is needed. When the tappet 420 is collapsed by draining most of the hydraulic fluid (and so long as the chamber 430 is not filled, as discussed further herein) the EGR poppet 332 remains closed. When the tappet 420 is fully filled, the poppet 332 undergoes full lift for maximum duration. Lesser lift and duration can be achieved by partially filling the tappet 420. The tappet's 420 fill can be controlled, for example, with an additional three-port control valve, similar to the one shown in FIG. 3*a*.

Stationary mode can be achieved in the embodiment shown in FIG. 4 by filling the chamber 430, for example through an additional three-port control valve. This prevents the tappet from returning under the pressure from the EGR valve spring 334. Thus, because of the chamber 430, the cam is able both to be in mechanical communication with the piston 336, and also to be removed from mechanical communication with it. Stationary mode, full lift, is therefore achieved by filling in the chamber 430 and the tappet 420. By fully filling the chamber 430 and partially filling the tappet 420, the poppet 332 is partially lifted in stationary mode.

Figure 5:
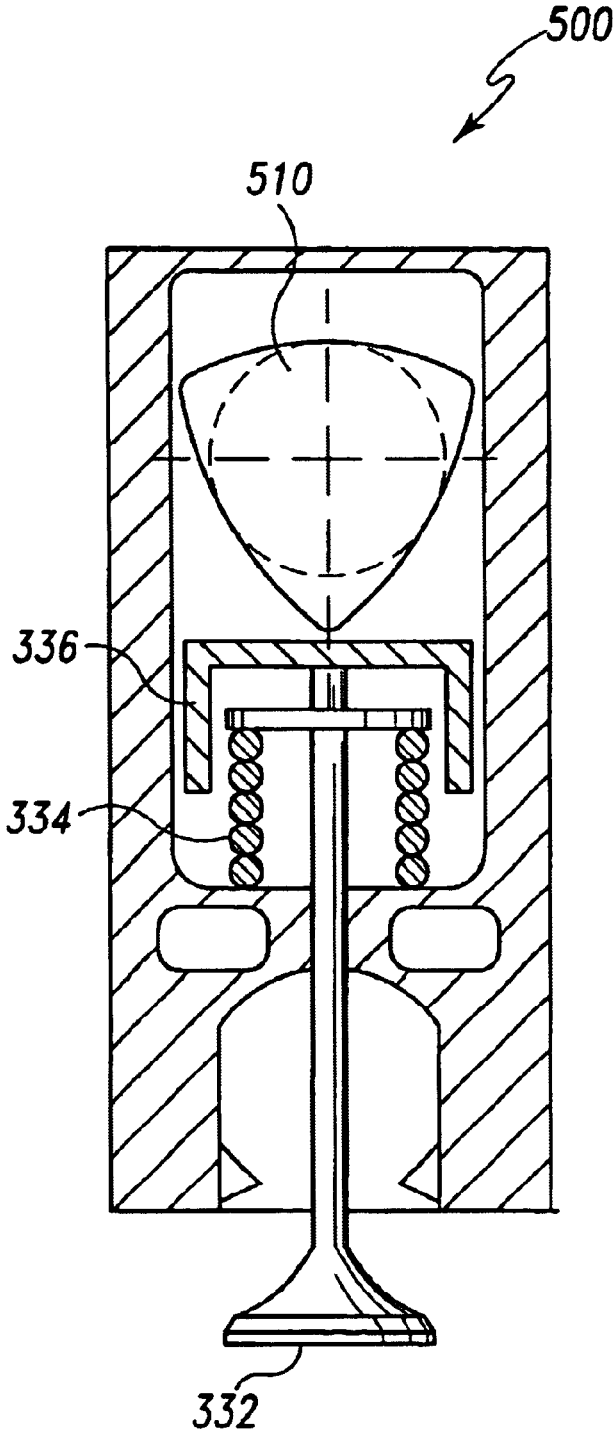
FIG. 5 is a cross-sectional view of an EGR valve according to the present invention employing an independently driven cam to drive the EGR valve.
Figure 6:
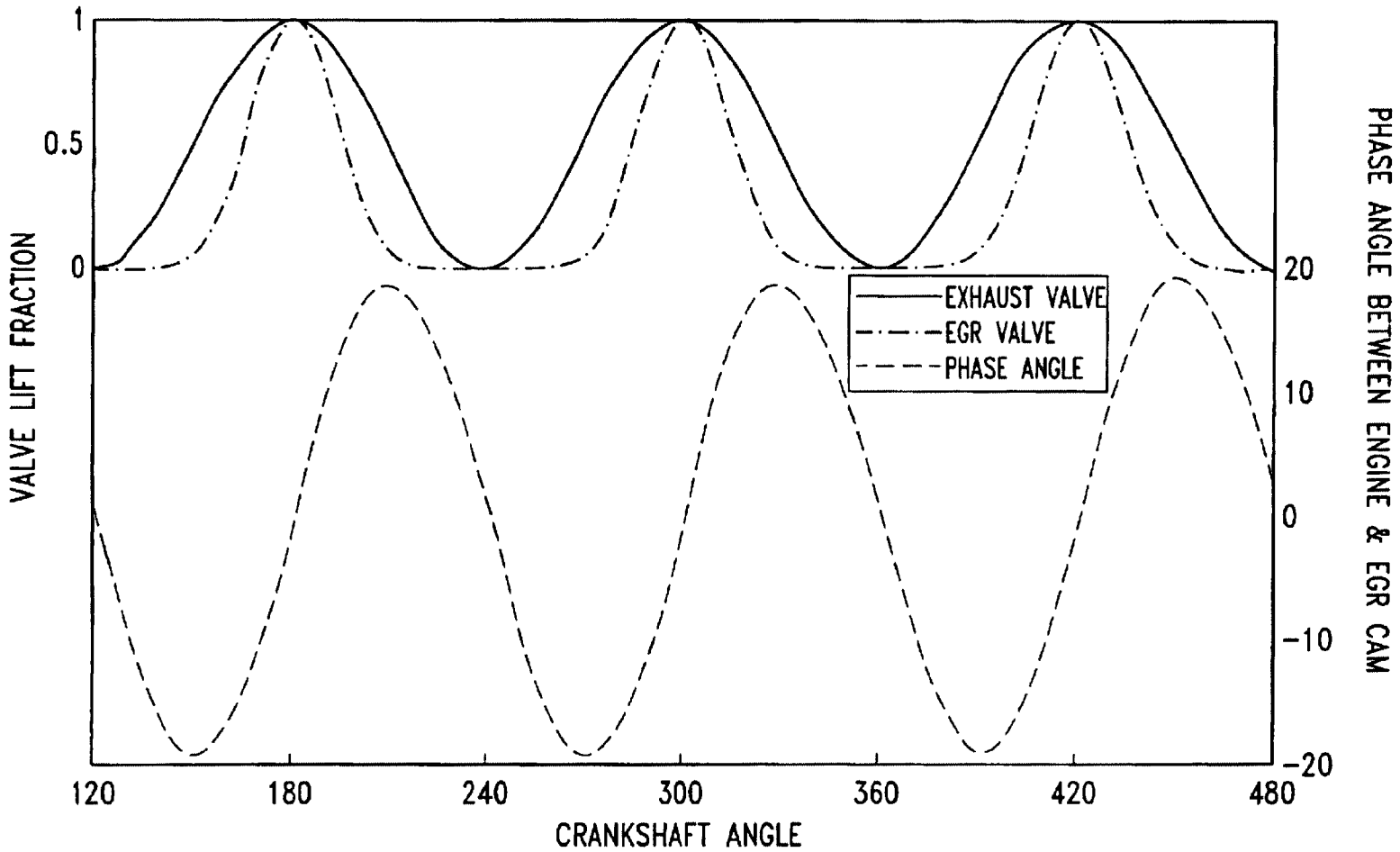
FIG. 6 is a graph of valve lift fraction vs. crankshaft angle illustrating a selective phase shift suitable to reduce EGR in a system employing the EGR valve of FIG. 5.
Figure 7:
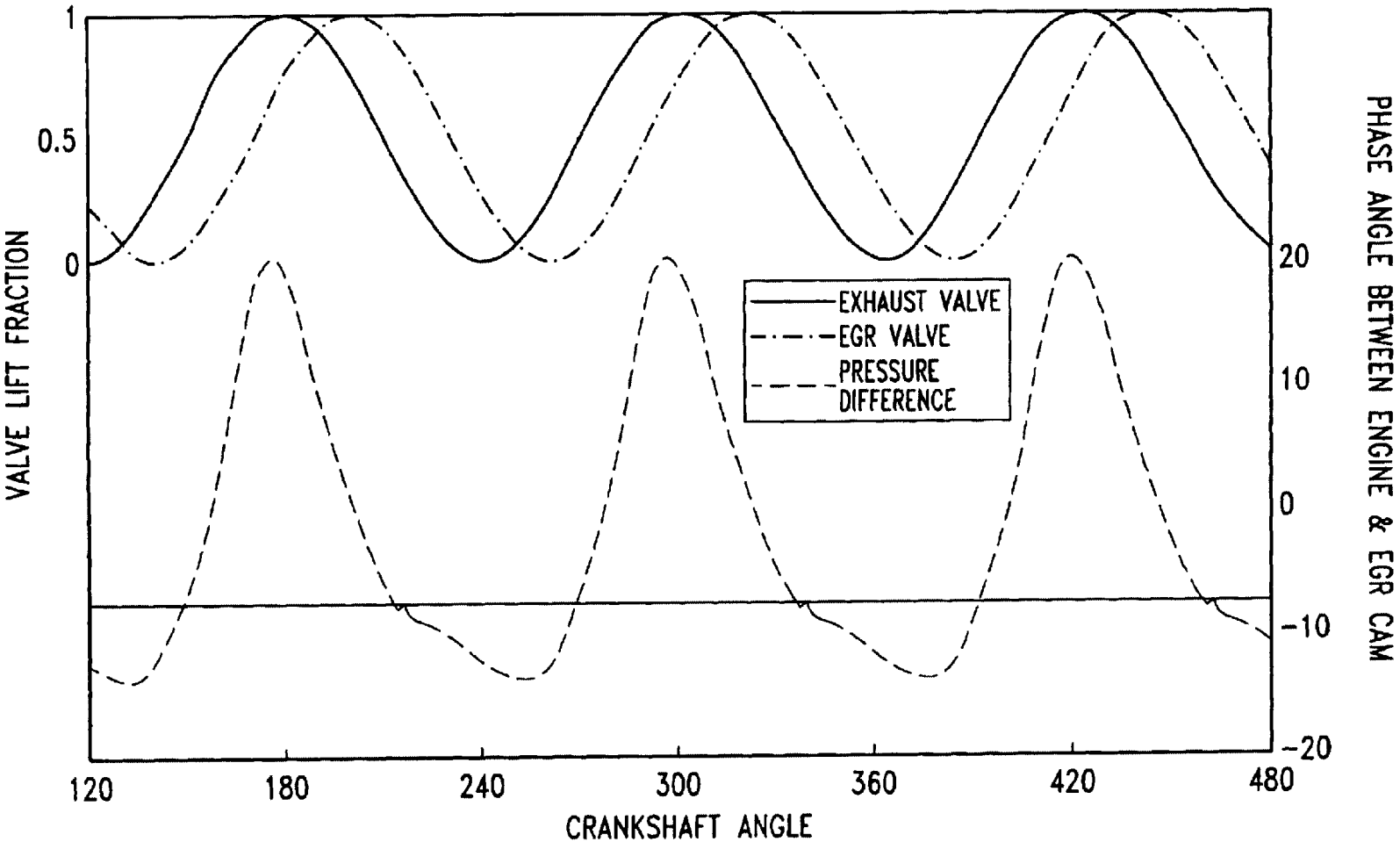
FIG. 7 is a graph of valve lift fraction vs. crankshaft angle illustrating a constant phase shift suitable to reduce EGR in a system employing the EGR valve of FIG. 5.

FIG. 5 illustrates certain alternative embodiment EGR valves, indicated generally as 500, in which the poppet 332 is driven by an independently driven cam 510 via a piston 336. The cam 510 may be driven, for example, by an independent electric motor. The piston 336 is biased by an EGR valve spring 334. These embodiments lack the chamber 430, so the cam 510 is always in mechanical communication with the piston 336 while the cam is in operation. Oscillating mode can be achieved by turning the cam 510 at some multiple of the engine speed. The number of lobes of the cam 510 and the rate of rotation is used to operate the EGR valve 500 preferably either at three times or six times the crankshaft revolution. The phase of the cam 510 rotation relative to the crankshaft or camshaft is advantageously maintained by a feedback controller using the crankshaft or camshaft and the motor as inputs. A controller suitable to permit continual adjustment in the phase difference as the motor rotates is advantageously used. This permits EGR flow reduction, for example, by accelerating the driving means relative to the engine while on the high-lift part of the cam, and decelerating relative to the engine while on the low-lift part of the cam. FIG. 6 illustrates this phase adjustment. Alternatively, a constant rotational velocity can be used in combination with a phase shift in order to reduce EGR flow, as illustrated in FIG. 7.

In these embodiments, stationary mode can be achieved simply by stopping the rotation of the cam 510 at the desired lift. A feedback system can again be used in combination with a linear transducer measuring the poppet lift directly in order to more accurately control the lift in stationary mode.

Since the poppet 332 is spring-closed, there will be counter-torque on the driving means through the cam 510 surface. In those embodiments in which the driving means is an electric motor, this counter-torque will require continuous current to maintain the position of the cam 510 at all positions other than maximum and minimum lift. Consequently, if there is an electrical failure, the spring and pressure forces will close the poppet 332. This is a desirable fail-safe condition. Only cam mechanisms have been shown with the motor-drive actuation mechanism, but those skilled in the art will appreciate that a linkage (a crank-slider, for example) mechanism could be used as well. This would preferably be used with a motor operating at three times engine speed (for a 6-cylinder engine). Such an actuator could be used without return spring 334, or with a much lower force spring, thereby reducing power demand on the motor in stationary mode at partial lift.

In certain alternative embodiments, the dual-mode EGR valve is driven by a three-way spool valve. In certain of these embodiments, a single-coil spool valve is used to reduce energy consumption.

Figure 8:
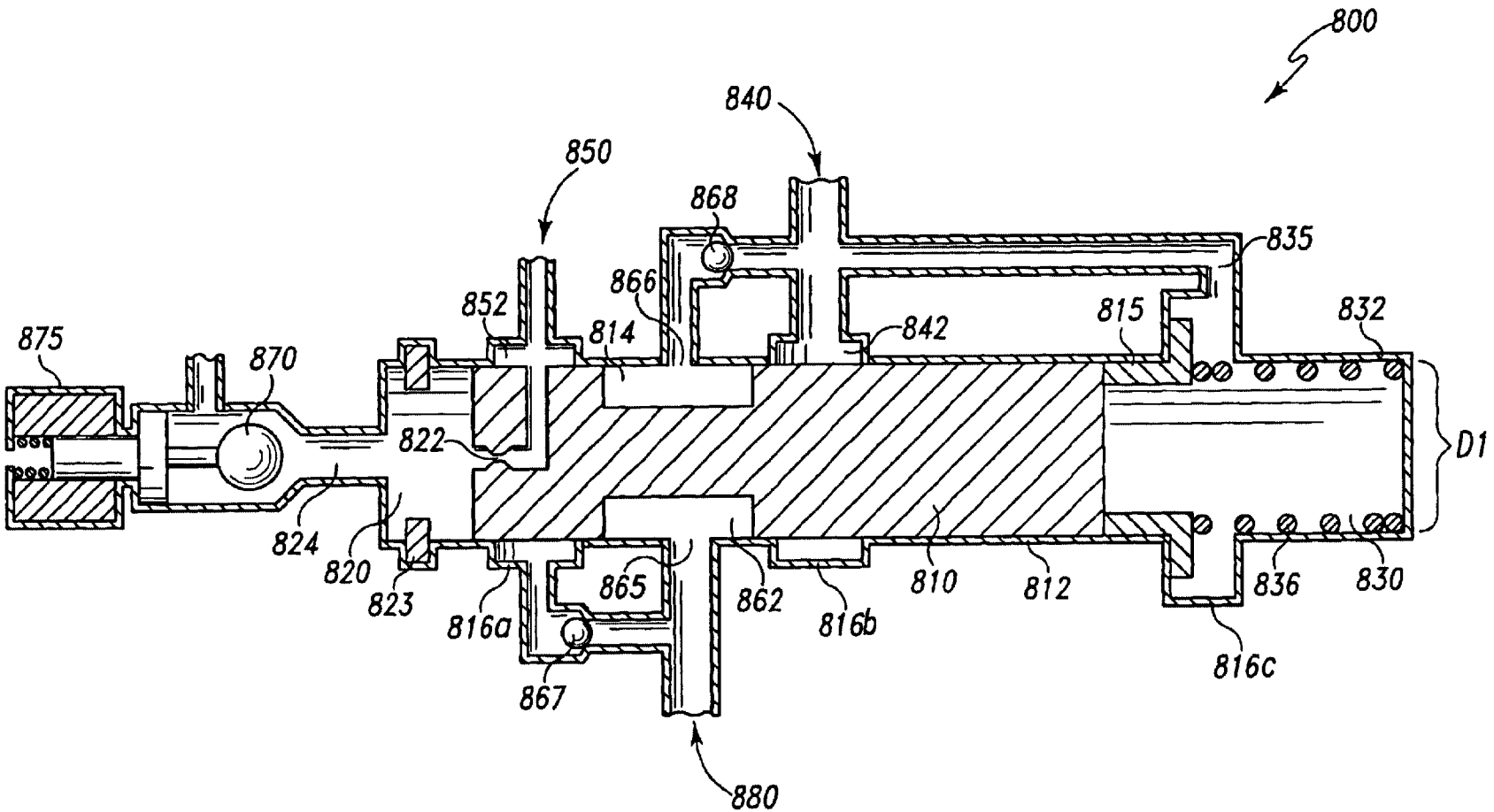
FIG. 8 is a cross-sectional view of a single-coil three-way spool valve suitable for use as an actuator for an EGR valve in a dual-mode EGR system.

FIG. 8 is a cross-section illustrating a single-coil three-way spool valve suitable for use to actuate the EGR valve 332 in two modes, indicated generally at 800. Those skilled in the art will appreciate that the single-coil spool valve 800 has several advantages over multi-coil spool valves. For example, because the travel of the spool is not set by the air gap of the solenoid (typically less than 0.5 mm for high-speed solenoids) the seal lengths can be much longer, reducing or eliminating leakage past the spool valve. Also, because the force for accelerating the spool is provided by hydraulic pressure rather than electromechanical force, much less power is required. And, of course, the need for one of the solenoids is eliminated, reducing the cost and improving reliability.

The spool valve 800 comprises a spool 810 in a sleeve 812 having a base inner diameter D1 equal to the base outer diameter of the spool 810. Thus, the spool 810 is free to travel along its axis of symmetry inside the sleeve 812 within a range bounded by positive stops at each end, discussed further herein. The spool 810 has a waist 814 narrower than the spool's base diameter D1. The sleeve 812 has three annular hips 816 having a diameter greater than the base diameter D1. A control reservoir 820 is positioned on one side of the spool 810 within the sleeve 812, and a low-pressure return reservoir 830 is on the other. The spool 810 and the annular hip 816*a* form a high-pressure chamber 852. The spool 810 and the hip 816*b* form a low-pressure chamber 842. The low-pressure annular chamber 842 is filled with hydraulic fluid in direct fluid communication with a low-pressure fluid reservoir 840, and the high-pressure annular chamber 852 is filled with hydraulic fluid in direct fluid communication with a high-pressure fluid reservoir 850. The waist 814 of the spool 810 and the sleeve 812 form an intermediate chamber 862, also filled with hydraulic fluid.

The intermediate chamber 862 has a first port 865 that provides direct fluid communication from the intermediate chamber 862 to an EGR valve actuator 880. Preferably, the EGR valve actuator 880 is a cylinder-piston type actuator, such as those shown in FIGS. 3 and 4. The first port 865 also provides checked fluid communication to the high-pressure chamber 852 through a first check valve 867. The first check valve 867 permits flow therethrough from the intermediate chamber 862 into the high-pressure chamber 852, but prevents flow in the opposite direction. The intermediate chamber also has a second port 866 that provides checked fluid communication from the intermediate chamber 862 to the low-pressure chamber 842 through a second check valve 868. The second check valve 868 permits flow from the low-pressure chamber 842 into the intermediate chamber 862, but prevents flow in the opposite direction. The check valves 867 and 868 are preferably ball-type check valves, as shown in FIG. 8, in order to provide high reliability and a good seal. However, other types of check valves, such as reed-type check valves, can conceivably be used.

The waist 814 of the spool 810 is long enough, relative to the axis of the spool 810, and positioned so that the high-pressure chamber 852 is placed in direct fluid communication with the first port 865 through the intermediate chamber 862 when the spool is in a first position, and so that the low-pressure chamber 842 is placed in direct fluid communication with the second port 866 through the intermediate chamber 862 when the spool is in a second position. The first and second positions are at the extreme ends of the spools' 810 range of motion. The waist 814 is short enough, relative to the axis of the spool 810, and positioned so that the intermediate chamber 862 is in direct fluid communication with neither the high-pressure chamber 852 nor the low-pressure chamber 842 when the spool 810 is in a at least a third position, which is somewhere between the first and second positions. The third position is preferably a position in which the spool is in contact with the hub 815, as discussed further herein.

The return reservoir 830 comprises a cylindrical portion 832 preferably having a diameter equal to D1, and the annular hip 816c. An aperture 835 in the return reservoir 830 permits fluid communication between the return reservoir 830 and the low-pressure fluid reservoir 840 and chamber 842. In the preferred embodiment, the aperture 835 is located in the hip 816*c*. The return reservoir 830 contains a hub 815 that extends axially towards the spool 810 from the hip 816*c*, and radially into the hip 816*c*. A return spring 836 biases the hub towards the end of the return reservoir 830 closer to the control reservoir 820 (leftward in FIG. 8). When the spool 810 travels to the left in FIG. 8, the interface between the hub 815 and the hip 816*c* prevents the hub 815 from moving rightward, and the hub 815 and spool 810 separate. When the spool 810 travels to the right, the spool 810 contacts the hub 815 and causes it to travel to the right as well, compressing the return spring 836. As the spool 810 continues to travel to the right, the interface between the hub 815 and the hip 816*c* creates a positive stop on the spool's 810 motion. The hub 815 and hip 816*c* are positioned to stop the spool 810 in the second position.

In the preferred embodiment, a stop ring 823 is positioned within the control reservoir 820 to act as a positive stop on the motion of the spool 810 away from the return reservoir 830 (leftward in FIG. 8) in the first position. However, any suitable type and position for a positive stop can be used, so long as it stops the spool 810 in the first position. For example, a stop ring could be located in the intermediate chamber.

As shown in FIG. 8, the high-pressure chamber 852 is in direct fluid communication with the control reservoir 820 through a narrow aperture 822. The control reservoir 820 also has a wide aperture 824 that is closed by a pilot valve 870. The pilot valve 870 is coupled to an actuator 875. The actuator 875 is preferably a solenoid. However, any suitable means of opening and closing the pilot valve may be used. The pressure in the control reservoir 820 can therefore be changed between a maximum and a minimum by opening or closing the pilot valve 870 to create a fluid flow through the control reservoir, from the high-pressure chamber 852 and out through the large aperture 824. The maximum pressure will occur when the pilot valve 870 is closed, and will essentially equal the pressure in the high-pressure reservoir 850. The width of the narrow aperture 822 and the wide aperture 824 are preferably selected so that the minimum pressure in the control reservoir 820 is less than about 10% of the maximum, depending on the ratio of the pressures in the high-pressure reservoir 850 and in the low-pressure reservoir 840. The pressure in the control reservoir 820 must at least drop below the pressure in the low-pressure reservoir 840, so that the spool will travel to the first position when the pilot valve 870 is opened.

The pressure in the high-pressure reservoir 850 and in the low-pressure reservoir 840, the base diameter D1 of the spool 810, and the spring constant of the spring 836 are selected so that the force on the spool 810 from the maximum pressure in the control reservoir 820 slightly exceeds the force on the spool 810 from the pressure in the return reservoir 830 plus the force of the spring 836 at maximum compression. This permits the spool 810 to be held in the second position against the force of the spring 836 by closing the pilot valve 870. The pressure in the low-pressure reservoir 840 is also selected to be high enough to prevent cavitation, especially in the EGR valve actuator 880 during changes in the acceleration of the EGR valve 332, discussed further herein. In the presently preferred embodiment, the pressure in the low-pressure reservoir 840 is about 300 psi, and the pressure in the high-pressure reservoir is about 3000–5000 psi. The EGR valve spring 334 is selected to have a spring constant such that it generates a force at maximum compression that is less than the force generated by the pressure in the high-pressure reservoir 850 when applied to the EGR valve actuator 880 and that is greater at maximum extension (i.e. when the valve is seated) than the force generated by the pressure in the low-pressure reservoir 840 when it is applied to the EGR valve actuator 880.

The EGR poppet 332 is actuated by the spool valve 800 through a number of phases. In order to begin opening the EGR poppet 332, the opening acceleration phase is begun by opening the pilot valve 870. This permits fluid to flow from the high-pressure reservoir 850 into the high-pressure chamber 852, through the narrow aperture 822 into the control reservoir 820, and then out through the wide port 824. The flow through the narrow aperture 822 and the wide aperture 824 causes a substantial drop in pressure in the control reservoir 820, causing the spool 810 to travel into the first position. In this position, fluid also flows from the high-pressure chamber 852 into the intermediate chamber 862, through the first port 865 and then into the EGR valve actuator 880. The high-pressure flow into the EGR valve actuator overcomes the bias of the EGR valve spring 334, and causes the maximum acceleration of the EGR poppet 332.

About halfway through the opening event (about 1.75 ms) the opening deceleration phase is begun by closing the pilot valve 870. This stops the flow of fluid from the high-pressure reservoir 850 into the control reservoir 820, causing the pressure in the control reservoir 820 to rise to nearly that of the high-pressure reservoir 850. This, in turn, causes the spool 810 to travel to the right. While the spool 810 is travelling rightward, the pressure in the return reservoir 840 exceeds the pressure in the low-pressure reservoir 840, causing fluid to flow from the return reservoir 830 into the low-pressure reservoir 840. So long as there is direct fluid communication between the high-pressure chamber 852 and the intermediate chamber 862, the second check valve 868 is held closed by high pressure from the high-pressure reservoir 850. During this period, the fluid volume exiting the return reservoir 730 all returns to the low-pressure reservoir 840. Once the spool 810 has traveled far enough to break the direct fluid communication between the high-pressure chamber 852 and the intermediate chamber 862, the pressure in the intermediate chamber 862 drops, so that some of the fluid volume exiting the return reservoir 830 flows through the second check valve 868. This flow continues to increase the EGR valve lift. As the spool 810 continues rightward it contacts the hub 815. At this point, the spring 836 begins to oppose the motion of the spool 810, decreasing the spool's 810 acceleration, until the spool 810 is stopped in the second position by the interface of the hub 815 and the hip 816*a*. When the spool's 810 travel stops, the low-pressure chamber 842 is in direct fluid communication with the first aperture 865 through the intermediate chamber 862. The EGR valve continues to open under its own inertia, but is decelerated by the EGR valve spring 334, which exerts a force greater than the low pressure from the low pressure reservoir 840 when it is compressed. Fluid continues to flow from the low-pressure reservoir 840 into the EGR valve actuator 880 until the EGR valve 332 reaches the desired maximum lift. This lift need not be the maximum lift of which the EGR valve 332 is physically capable.

Once the desired maximum lift of the EGR valve 332 has been achieved, the fixed lift phase is initiated and maintained by rapidly opening and closing the pilot valve 880. This causes the pressure in the control reservoir 820 to oscillate rapidly (preferably on the order of 1–2 ms per cycle), creating a mean pressure somewhere between the maximum and minimum. The opening and closings of the pilot valve 870 are timed to produce a mean pressure in the control reservoir 820 that slightly exceeds the pressure in the low-pressure reservoir 840, but that is insufficient to force the spool 810 to sufficiently compress the spring 836 so as to permit the spool 810 to travel rightward far enough to place the intermediate chamber 862 in direct fluid communication with the low-pressure chamber 842. Preferably, the mean pressure in the control reservoir is roughly equal to 20% to 80% of the high-pressure reservoir 850. Thus, the spool 810 travels leftward until it reaches an intermediate position in which the intermediate chamber 862 is in fluid communication with the high-pressure reservoir 850 only through the first check valve 867 and with the low-pressure reservoir 840 only through the second check valve 868. The spool 810 remains in the intermediate position as long as the pilot valve 880 is oscillated in this way. The openings and closings of the pilot valve 870 are also timed to produce a mean pressure in the control reservoir 820 that prevents fluid from flowing from the EGR valve actuator 880 back through the first check valve into the control reservoir 820. Likewise, fluid cannot flow from the EGR valve actuator 880 into the low-pressure reservoir, because the second check valve is biased in the other direction. Thus, the EGR valve 332 remains at a fixed lift as long as the pilot valve 880 is oscillated in this way. Typically, the fixed lift phase lasts between 1 and 43 ms when the EGR valve system is operating in oscillating mode. The fixed-lift phase typically lasts much longer when the EGR valve system is operating in stationary mode.

In certain alternative embodiments, the pilot valve is adapted to use a variable current in a solenoid coil in order to generate a variable force on the valve stop. In these embodiments, rather than rapidly opening and closing the pilot valve 870, the fixed lift phase can be established by using the pilot valve 870 as a pressure-control valve. The force on the valve stop is selected so that, as long as the pressure in the control reservoir 820 remains higher than desired, it forces the pilot valve 870 open, permitting fluid to flow out the wide aperture 824, causing the pressure, in turn, to drop. Once the desired pressure is reached, the force on the valve stop is sufficient to keep the pilot valve 870 closed. Thus, a stable equilibrium is established about the desired pressure in the control reservoir 820.

The closing acceleration phase is begun by leaving the pilot valve 870 closed for an extended period roughly equal to half the closing event period (1.75 ms). The spool 810 travels back to the right into the second position. The EGR valve spring 334 begins to accelerate the EGR valve 332 towards the closed position, displacing fluid volume from the EGR valve actuator back through the intermediate chamber 862, the low-pressure chamber 842, and into the low-pressure reservoir 840.

About halfway through the valve closing event (again about 1.75 ms) the closing deceleration phase is begun by opening the pilot valve 870. Again, the pressure in the control reservoir 820 drops, and the spool 810 travels leftward into the first position. Because the pressure behind the first check valve 867 drops along with the pressure in the control reservoir 820 fluid flows back through the check valve before the spool 810 travels far enough to place the EGR valve actuator 880 in fluid communication with the high-pressure reservoir 850 through the intermediate chamber 862. Although the EGR valve spring 334 exerts less force than the fluid pressure on the EGR valve actuator 880, the valve continues to close under the momentum of the EGR valve 332, returning some of the fluid and energy to the high-pressure reservoir.

Once the valve has stopped moving, the valve seating phase is begun by again closing the pilot valve 870. The spool 810 returns to the second position, so that the EGR valve actuator is in fluid communication with the low-pressure reservoir 840 through the intermediate chamber 862. The EGR valve spring 334 generates sufficient force to overcome the low pressure, and therefore permits the valve to completely seat, displacing fluid volume from the EGR valve actuator 880 back into the low-pressure reservoir 840.

Figure 9:
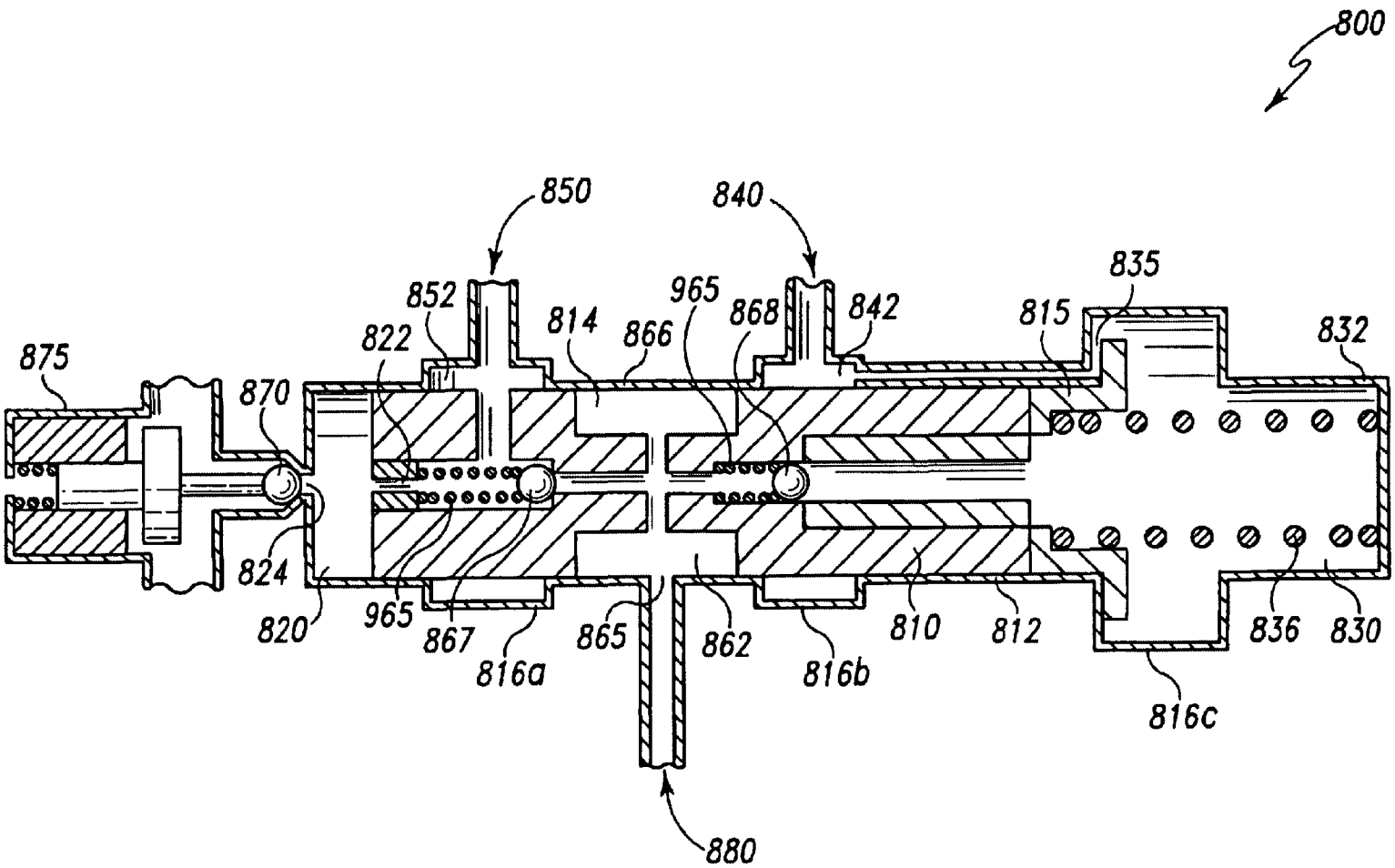
FIG. 9 is a cross-sectional view of a single-coil three-way spool valve suitable for use as an actuator for an EGR valve in a dual-mode EGR system.

FIG. 9 is a cross-section illustrating an alternative geometry for the single-coil three-way spool valve 800. In order to accommodate this geometry, in the embodiments in which the first check valve 867 is a ball-type valve, the ball must be biased towards the intermediate chamber 862 so that the fluctuations in pressure behind the ball resulting from the fluid flow into the control reservoir 820 do not cause the ball to interrupt that flow, and so that the ball will properly return to stop the flow of fluid into the intermediate chamber. Similarly, if the second check valve 868 is a ball-type valve, the ball must be biased away from the intermediate chamber 862. In each case, the balls may be biased by a spring 965, as shown in FIG. 9. Other means of biasing may be used, as would occur to one skilled in the art. For example, in reed-type check valves the bias is typically inherent in the construction of the reed.

The EGR lift valve can be cycled from closed to open and back to closed again by the actuation of the pilot valve 870, as will be apparent to those skilled in the art.

It will be appreciated that the single-coil three-way spool valve 800 can be used as the actuator for a dual-mode EGR valve. In the oscillating mode, the spool valve 800 goes through the six phases in a regular period timed to cause the EGR valve to open in synchronism with the blow down events of one or more engine cylinders. In the static mode, the opening acceleration and deceleration phases are timed to produce the desired valve lift, and then the spool is placed and left in the fixed lift mode so long as the EGR valve is desired to operate in static mode.

It will also be appreciated that single-coil three-way spool valve 800 can be used in other applications that can benefit from variable valve timing, including some applications outside of EGR operation. For example, intake valves can be controlled in order to achieve Miller cycle operation, or to improve startability and reduce white smoke with LIVO (late intake valve opening). Reduced cranking torque can also be used to reduce the compression ratio during startup. Exhaust valves can be controlled in order to achieve engine compression braking. The entire engine can be switched between two-stroke and four-stroke operation. Fuel efficiency can be improved with improved transient response, optimized timing, with variable engine displacement (selective deactivation of cylinders during partial load conditions), or with LEVO (late exhaust valve opening, in order to trade increase the expansion ratio at the cost of turbocharger power), or with any combination of these. It is contemplated that the three way spool valve 800 may be used with any variable valve timing application, as would occur to one skilled in the art.

While the invention has been illustrated and described in detail in the drawings and foregoing description, the same is to be considered as illustrative and not restrictive in character, it being understood that only the preferred embodiment, and certain alternative embodiments deemed helpful in further illuminating the preferred embodiment, have been shown and described and that all changes and modifications that come within the spirit of the invention are desired to be protected.

We claim:

1. An EGR system for use on an internal combustion engine, the EGR system comprising; at least one hydraulic master cylinder; a slave cylinder in fluid communication with the hydraulic master cylinder and having a slave piston; an EGR valve coupled to the slave piston and biased in a closed position:

a hydraulic manifold in fluid communication with the at least one hydraulic master cylinder and the slave cylinder;

a three-port control valve having a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state, the second port having a check valve to prevent backflow of hydraulic fluid from the hydraulic manifold into the source of hydraulic fluid; and a mode control valve separating the hydraulic manifold and the slave cylinder, the mode control valve comprising:

a check valve that permits fluid to flow from the hydraulic manifold into the slave cylinder, and a closeable bypass that, when open, permits fluid to flow from the hydraulic manifold into the slave cylinder and from the slave cylinder into the hydraulic manifold.

2. The EGR system of claim 1, wherein the EGR valve is biased with a spring.

3. The EGR system of claim 1, wherein the at least one hydraulic master cylinder is actuated by at least one rocker arm of the engine.

4. The EGR system of claim 1, wherein the at least one hydraulic master cylinder is actuated by at least one cam follower of the engine.

5. An EGR system for use on an internal combustion engine, the

EGR system comprising:

at least one hydraulic master cylinder;

a slave cylinder in fluid communication with the hydraulic master cylinder and having a slave piston;

a hydraulic manifold in fluid communication with the at least one hydraulic master cylinder and the slave cylinder;

an EGR valve coupled to the slave piston and biased in a closed position, a three-port control valve having a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state, the second port having a check valve to prevent backflow of hydraulic fluid from the hydraulic manifold into the source of hydraulic fluid;

a mode control valve separating the hydraulic manifold and the slave cylinder, the mode control valve comprising:

a check valve that permits fluid to flow from the hydraulic manifold into the slave cylinder;

a closeable bypass that, when open, permits fluid to flow from the hydraulic manifold into the slave cylinder and from the slave cylinder into the hydraulic manifold; and wherein the at least one hydraulic master cylinder is actuated by at least one rocker arm of the engine.

6. The EGR system of claim 5, further comprising:

a bleed line having at least one aperture in the slave cylinder, the aperture being positioned to be uncovered only when the piston is at one extreme of its range of motion.

7. An EGR system, comprising: a EGR valve biased in a closed position; a piston coupled to the EGR valve; a cam at least able to be in mechanical communication with the piston, such that when the cam rotates the piston is actuated, wherein the cam is in contact with the piston, such that the cam is always in mechanical communication with the piston while the cam is operating; and; a motor coupled to the cam.

8. An EGR system, comprising:

a EGR valve biased in a closed position;

a piston coupled to the EGR valve;

a cam at least able to be in mechanical communication with the piston, such that when the cam rotates the piston is actuated, wherein the cam is in contact with the piston, such that the cam is always in mechanical communication with the piston while the cam is operating, further comprising:

a variable tappet that places the cam and piston in mechanical communication when the tappet is at least partially collapsed.

9. The EGR system of claim 8, further comprising:

a chamber in contact with the tappet;

a fill line adapted to direct hydraulic fluid into the chamber;

wherein the EGR valve is at least partially opened and the cam is removed from mechanical communication with the piston when the chamber contains more than a pre-determined amount of fluid.

10. An EGR system, comprising:

a EGR valve biased in a closed position;

a piston coupled to the EGR valve; a cam at least able to be in mechanical communication with the piston, such that when the cam rotates the piston is actuated, wherein the cam is in contact with the piston, such that the cam is always in mechanical communication with the piston while the cam is operating, further comprising:

a chamber in contact with the tappet;

a fill line adapted to direct hydraulic fluid into the chamber;

wherein the EGR valve is at least partially opened and the cam is removed from mechanical communication with the piston when the chamber contains more than a pre-determined amount of fluid.

11. An EGR system, comprising:

a EGR valve biased in a closed position;

a piston coupled to the EGR valve;

a spool valve coupled to the piston to permit the EGR valve to be opened and closed;

an actuator coupled to the spool valve, wherein the actuator comprises only a single coil.

12. A dual mode EGR system for use on a combustion engine having an intake line and a compressor, the EGR system comprising:

an EGR passage having at least one aperture that opens into the intake line downstream of the compressor;

an EGR valve that blocks flow through the EGR passage when closed;

an actuator coupled to the EGR valve, and adapted to operate in at least a first mode and a second mode;

wherein in the first mode, the actuator at least partially opens the EGR valve and leaves it at least partially open for a period at least long enough for two cylinders to fire; and wherein in the second mode, the actuator successively opens and closes the EGR valve synchronously with increases in a pressure in the EGR passage.

13. The dual mode EGR system of claim 12, wherein the actuator operates in the second mode only when a mean pressure in the EGR passage is less than a mean pressure in the intake line near the at least one aperture.

14. The dual mode EGR system of claim 12, wherein the actuator comprises a single-coil three-way spool valve.

15. The dual mode EGR system of claim 12, wherein the actuator comprises:

a EGR valve biased in a closed position;

a piston coupled to the EGR valve;

a cam at least able to be in mechanical communication with the piston, such that when the cam rotates the piston is actuated.

16. The dual mode EGR system of claim 15, wherein the cam is in contact with the piston, such that the cam is always in mechanical communication with the piston while the cam is operating.

17. The dual mode EGR system of claim 16, further comprising a motor coupled to the cam.

18. The dual mode EGR system of claim 15, further comprising a variable tappet that places the cam and piston in mechanical communication when the tappet is collapsed by at least a pre-determined amount.

19. The dual mode EGR system of claim 18, further comprising:

a chamber in contact with the tappet;

a fill line adapted to direct hydraulic fluid into the chamber;

wherein the EGR valve is at least partially opened and the cam is removed from mechanical communication with the piston when the chamber contains more than a pre-determined amount of fluid.

20. The dual mode EGR system of claim 12, wherein the actuator operates in the second mode when the engine is operating near torque peak.

21. The dual mode EGR system of claim 20, wherein the actuator opens the EGR valve only when a pressure in the EGR passage is greater than a pressure in the intake line near the at least one aperture.

22. The dual mode EGR system of claim 20, wherein the actuator comprises a spool valve.

23. The dual mode EGR system of claim 20, wherein the actuator comprises a single-coil three-way spool valve.

24. The dual mode EGR system of claim 20, wherein the actuator comprises:

at least one hydraulic master cylinder;

a slave cylinder in fluid communication with the hydraulic master cylinder and having a slave piston, the slave cylinder is coupled to the EGR valve; and wherein the EGR valve is biased in a close position.

25. The dual mode EGR system of claim 24, wherein the EGR valve is biased with a spring.

26. The dual mode EGR system of claim 24, wherein the at least one hydraulic master cylinder is actuated by at least one rocker arm of the engine.

27. The dual mode EGR system of claim 24, wherein the at least one hydraulic master cylinder is actuated by at least one cam follower of the engine.

28. The dual mode EGR system of claim 24, wherein the actuator comprises:

a hydraulic manifold in fluid communication with the at least one hydraulic master cylinder and the slave cylinder;

a three-port control valve having a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state, the second port having a check valve to prevent backflow of hydraulic fluid from the hydraulic manifold into the source of hydraulic fluid; and a mode control valve separating the hydraulic manifold and the slave cylinder, the mode control valve comprising:

a check valve that permits fluid to flow from the hydraulic manifold into the slave cylinder; and a closeable bypass that, when open, permits fluid to flow from the hydraulic manifold into the slave cylinder and from the slave cylinder into the hydraulic manifold.

29. The dual mode EGR system of claim 28, further comprising:

a bleed line having at least one aperture in the slave cylinder, the aperture being positioned to be uncovered only when the piston is at one extreme of its range of motion.

30. A dual mode EGR system for use on a combustion engine having an intake line and a compressor, the EGR system comprising:

an EGR passage having at least one aperture that opens into the intake line downstream of the compressor;

an EGR valve that blocks flow through the EGR passage when closed, a spring disposed to bias the EGR valve in a closed position;

an actuator coupled to the EGR valve, and adapted to operate in at least a first mode and a second mode, the actuator comprising:

at least one hydraulic master cylinder;

a slave cylinder in fluid communication with the hydraulic master cylinder and having a slave piston, the slave piston being coupled to the EGR valve; and a hydraulic manifold in fluid communication with the at least one hydraulic master cylinder and the slave cylinder;

a three-port control valve having a first port in fluid communication with the hydraulic manifold, a second port in fluid communication with a source of hydraulic fluid when the three-port control valve is in a first state, and a third port in fluid communication with a hydraulic fluid drain when the three-port control valve is in a second state, the second port having a check valve to prevent backflow of hydraulic fluid from the hydraulic manifold into the source of hydraulic fluid; and a mode control valve separating the hydraulic manifold and the slave cylinder, the mode control valve comprising:

a check valve that permits fluid to flow from the hydraulic manifold into the slave cylinder; and a closeable bypass that, when open, permits fluid to flow from the hydraulic manifold into the slave cylinder and from the slave cylinder into the hydraulic manifold; and wherein when the engine operates near torque peak the actuator functions in the second mode by placing the three-port control valve in the second state and opening the closable bypass.

31. The dual mode EGR system of claim 30, wherein the three-port control valve is placed in the second state and the closable bypass is opened, such that the actuator functions in the second mode when a mean pressure in the EGR passage is less than a mean pressure in the intake line near the at least one aperture.

32. The dual mode EGR system of claim 30, wherein the three-port control valve is placed in the second state and the closable bypass is opened, such that the actuator functions in the second mode only when a pressure in the EGR passage is greater than a pressure in the intake line near the at least one aperture.

33. A dual mode EGR system for use on a combustion engine having an intake line and a compressor, the EGR system comprising:

an EGR passage having at least one aperture that opens into the intake line downstream of the compressor;

an EGR valve that blocks flow through the EGR passage when closed, a spring disposed to bias the EGR valve in a closed position;

an actuator coupled to the EGR valve, and adapted to operate in at least a first mode and a second mode, the actuator comprising:

a piston coupled to the EGR valve;

a cam in mechanical communication with the piston, such that when the cam rotates the piston is actuated;

a motor coupled to the cam; and wherein the motor of the actuator is moved to and left in an angular position that opens the EGR valve unless the engine is operating near torque peak.

34. The dual mode EGR system of claim 33, wherein the motor of the actuator turns the cam at an angular velocity and angular displacement with a timing of the engine selected so as to cause the EGR valve to open and close synchronously with increases in a pressure in the EGR passage above a pressure in the intake line near the at least one aperture.

35. The dual mode EGR system of claim 34, wherein the angular velocity and angular displacement are varied such that an amount of EGR is controlled.

36. A dual mode EGR system for use on a combustion engine having an intake line and a compressor, the EGR system comprising:

an EGR passage having at least one aperture that opens into the intake line downstream of the compressor;

an EGR valve that blocks flow through the EGR passage when closed, a spring disposed to bias the EGR valve in a closed position;

an actuator coupled to the EGR valve, and adapted to operate in at least a first mode and a second mode, the actuator comprising:

a piston coupled to the EGR valve;

a cam;

a chamber;

a fill line adapted to direct hydraulic fluid into the chamber;

a variable tappet in contact with the chamber and that places the cam and piston in mechanical communication, such that the piston opens the EGR valve when the cam rotates, when the tappet is collapsed at least a predetermined amount and the chamber is not filled;

wherein when the chamber contains more than a predetermined amount of fluid the tappet is actuated such that the EGR valve is at least partially opened and the cam is removed from mechanical communication with the piston.

37. A dual mode EGR system for use on a combustion engine having an intake line and a compressor, the EGR system comprising:

an EGR passage having at least one aperture that opens into the intake line downstream of the compressor;

an EGR valve that blocks flow through the EGR passage when closed, an actuator coupled to the EGR valve, and adapted to operate in at least a first mode and a second mode, the actuator comprising:

a cylinder;

a piston disposed within the cylinder and coupled to the EGR valve;

a spring disposed to bias the EGR valve in a closed position;

a spool valve comprising:

a spool;

a sleeve;

a high-pressure reservoir;

a low-pressure reservoir;

an intermediate chamber disposed to be in direct fluid communication with the high-pressure reservoir when the spool is in a first position, to be in direct fluid communication with the low-pressure reservoir when the spool is in a second position, and to be out of direct fluid communication with both the high-pressure and low-pressure reservoirs when the spool is in a third position;

at least one solenoid disposed to move the spool between the first, second, and third positions;

wherein the intermediate chamber is in direct fluid communication with the cylinder;

wherein the spool valve actuates the EGR valve by causing fluid to flow into and out of the cylinder by placing the cylinder into direct fluid communication with the high-pressure reservoir and the low-pressure reservoir, respectively, wherein when the engine operates near torque peak the actuator functions in the first mode by placing the spool in the third position.

38. The dual mode EGR system of claim 37, wherein the at least one solenoid comprises fewer than two solenoids.

39. The dual mode EGR system of claim 38, wherein the spool valve further comprises:

a first check valve between;

a second check valve;

a pilot valve.

40. A three-way spool valve, comprising:

a sleeve having an axis, and a first aperture, a second aperture, and a third aperture;

a spool disposed within the sleeve so as to be able to move within the sleeve between at least a first, second, and third position, the waist of the spool and the sleeve defining an intermediate chamber;

a high-pressure reservoir in direct fluid communication with the first aperture;

a low-pressure reservoir in direct fluid communication with the second aperture;

a control reservoir positioned within the sleeve adjacent to a first end of the spool, in direct fluid communication with the high-pressure reservoir through a narrow aperture, the control reservoir having a closable large aperture, such that the pressure in the control reservoir can be altered by opening and closing the closable large aperture, whereby a force on the spool in a first axial direction created by the pressure in the control reservoir can likewise be altered;

a return reservoir positioned within the sleeve adjacent to a second end of the spool in direct fluid communication with the low-pressure reservoir;

a spring positioned within the return reservoir to oppose motion of the spool in the first axial direction created by the pressure in the control reservoir at least when the second end of the spool has moved in the first axial direction past a first predetermined point along the axis;

wherein the first and third apertures are positioned to be in direct fluid communication with the intermediate chamber when the spool is in the first position; and wherein the second and third apertures are positioned to be in direct fluid communication with the intermediate chamber when the spool is in the second position.

41. The three-way spool valve of claim 40, further comprising:

a first check valve;

a second check valve;

wherein the first and third apertures are in checked fluid communication through the first check valve, the first check valve being biased to permit flow therethrough from the third aperture to the first aperture;

wherein the second and third apertures are in checked fluid communication through the second check valve, the second check valve being biased to permit flow therethrough from the second aperture to the third aperture.

42. The three-way spool valve of claim 40, wherein the pressure in the low-pressure reservoir is sufficient to substantially prevent cavitation;

wherein the pressure in the high-pressure reservoir is sufficient to generate a force in the first axial direction sufficient to overcome a force in the second axial direction generated by the pressure in the low-pressure reserve plus a force generated by the spring at maximum compression.

43. The three-way spool valve of claim 40, further comprising:

a first positive stop positioned to prevent the spool from travelling past the first position in a second axial direction;

a second positive stop positioned to prevent the spool from travelling past the second position in the first axial direction.

44. The three-way spool valve of claim 43, wherein the first positive stop comprises a stop ring having a diameter less than a diameter of the spool, the stop ring being affixed to the sleeve, and wherein the second positive stop comprises a hub disposed within the return reservoir, the return reservoir having an annular hip of a greater diameter than the rest of the reservoir, the hub extending radially into the annular hip.

* * * * *

UNITED STATES PATENT AND TRADEMARK OFFICE

CERTIFICATE OF CORRECTION

PATENT NO. : 6,964,270 B2
DATED : November 15, 2005
INVENTOR(S) : Janssen et al.

It is certified that error appears in the above-identified patent and that said Letters Patent is hereby corrected as shown below:

Column 3,
Line 65-67, delete the paragraph "The EGR lift valve can be cycled from closed to open and back to closed again by the actuation of the pilot valve 870, as will be apparent to those skilled in the art.".

Column 13,
Line 41, replace "engine, the [carriage return] EGR system comprising:" with -- engine, the EGR system comprising: --.

Signed and Sealed this

Thirty-first Day of January, 2006

JON W. DUDAS
*Director of the United States Patent and Trademark Office*